United States Patent [19]

Myers et al.

[11] Patent Number: 4,586,572

[45] Date of Patent: May 6, 1986

[54] WELL DRILLING APPARATUS

[75] Inventors: Thomas A. Myers, 3757 Perry La., Corpus Christi, Tex. 78410; Robert P. Barnes, Corpus Christi, Tex.

[73] Assignee: Thomas A. Myers, Corpus Christi, Tex.

[21] Appl. No.: 608,962

[22] Filed: May 10, 1984

[51] Int. Cl.[4] ..... E21B 19/00

[52] U.S. Cl. ..... 175/85; 414/22

[58] Field of Search ..... 175/52, 85, 162, 220; 414/22

[56] References Cited

U.S. PATENT DOCUMENTS

| | | | |
|---|---|---|---|
| 2,792,198 | 5/1957 | Braun | 175/85 |
| 3,198,263 | 8/1965 | Reischl | 173/44 |
| 3,212,593 | 10/1965 | Reischl | 175/85 |
| 3,245,180 | 4/1966 | Bules et al. | 52/143 |
| 3,252,527 | 5/1966 | Alexander et al. | 173/44 |
| 3,265,138 | 8/1966 | Alexander et al. | 175/85 |
| 3,280,920 | 10/1966 | Scott | 175/85 |
| 3,340,938 | 9/1967 | Wilson | 173/44 |
| 3,443,647 | 5/1969 | Jenkins et al. | 175/85 |
| 3,451,493 | 6/1969 | Storm | 175/85 |
| 3,499,498 | 3/1970 | Bromell et al. | 175/52 |
| 3,561,616 | 2/1971 | Eddy et al. | 175/85 |
| 3,650,339 | 3/1972 | Selfe et al. | 175/85 |
| 3,805,902 | 4/1974 | Storm et al. | 175/85 |
| 3,961,673 | 6/1976 | Wolters et al. | 175/52 |

FOREIGN PATENT DOCUMENTS

| | | | |
|---|---|---|---|
| 2630136 | 1/1977 | Fed. Rep. of Germany | 175/52 |

*Primary Examiner*—Stephen J. Novosad
*Assistant Examiner*—William P. Neuder
*Attorney, Agent, or Firm*—Vaden, Eickenroht, Thompson & Jamison

[57] ABSTRACT

There is disclosed well drilling apparatus which includes a mast pivotally mounted on a base so that it may be tilted about a horizontal axis in order to drill a well at a slant with respect to the vertical, a laydown device at the front side of the mast for use in moving joints of drill pipe to and from the mast, during drilling of the well or on completion of the drilling, and a tower and setback in which stands of drill pipe may be racked, together with a frame extending between the mast and tower to facilitate transfer of the stands of drill pipe between the tower and the mast during tripping of the drill string—i.e., as it is raised from the well, to permit repair or replacement of the drill bit, and then lowered back into the well to resume drilling.

17 Claims, 22 Drawing Figures

WELL DRILLING APPARATUS

This invention relates generally to well drilling apparatus, and, more particularly, to improved apparatus of this type which includes a mast which is pivotally mounted on a base so that it may be tilted about a horizontal axis in order to drill the wells at a slant with respect to the vertical. In one of its aspects, it relates to improvements in the means by which pipe is moved between the mast and a laydown device at the front side of the mast as pipe is added to the drill string in the mast, during drilling of the well, or as pipe is returned to the laydown device, when the well has been drilled and the drill string is removed therefrom. In another of its aspects, it relates to improvements in the means by which a stand of pipe—e.g., "doubles" or "trebles"—is transferred between the mast and a substantially vertical racking tower mounted on the front side of the mast during "tripping" of the drill string—i.e., as the drill string is raised from the well, to permit repair or replacement of the drill bit at its lower end, and then lowered back into the well to resume drilling.

In prior apparatus of this type, such as that shown in U.S. Pat. Nos. 3,451,493 and 3,805,902, it has been proposed to move the pipe to and from the pipe laydown device by means of an elevator suspended from a traveling block at the upper end of the mast in such a manner that the elevator may be swung into a position to grip the front end of a pipe supported at its ends on the device, and then lifted to raise the pipe into a position in which it may be guided by arms on the mast into alignment with the drilling axis of the mast and then lowered to connect it to the upper end of the drill string suspended in a rotary table at the lower end of the mast. Then, in order to lay the pipe down, upon disconnection from the drill string, it may be lowered with the elevator and guided by the arms on the mast to lower its outer end onto the device, whereby, upon continued lowering, its outer end moves along the device until its front end is also lowered onto the device to return the pipe to a horizontal position on the device. In order to facilitate this movement of the pipe to and from the mast, the laydown device includes means by which the front end of the pipe may be raised above the rotary table and then moved forwardly to dispose it closer to the drilling axis, and thus in a position more accessible for gripping by the elevator, and then moved back over the rotary as the pipe is lowered back onto the device.

As also shown and described in the aforementioned patents, the elevator suspended from the traveling block and replaced by a swivel from which a kelly is suspended, and the pipe which has been moved into the mast is connected at its upper end to the lower end of the kelly, and then lowered with the kelly by means of the swivel in order to connect its lower end to the upper end of the remainder of the drill string supported by slips in the rotary table at the lower end of the mast. In the prior apparatus of this type, it has been necessary for this connection between the kelly and the drill pipe being added to the drill string to be made up by a kelly spinner on the drilling swivel. As a result, it has not been possible to torque the joint properly, so that there is some risk that the joint may leak or the pipe be dropped from the kelly as the pipe is being lowered into the well with the remainder of the drill string.

An object of this invention is to provide well drilling apparatus of this type in which the kelly may be torqued properly with the drill pipe prior to lowering of the pipe into the well, with the remainder of the drill string.

It is a more particular object to provide a laydown device which is especially well suited for use with apparatus as described in the foregoing object.

In U.S. Pat. No. 3,805,902, as well as in other prior apparatus of this type, such as U.S. Pat. Nos. 3,443,647, 3,561,616, and 3,650,339, a frame extends between the mast and the tower to serve various purposes, such as providing a catwalk between the mast and tower, as well as a guide for the stand of pipe as it is moved between the mast and tower. In U.S. Pat No. 3,805,902, the lower end of the stand to be transferred is adapted to be received in a cup pivotable about a horizontal axis at the lower end of the mast, and an endless cable is wound about sheaves on the mast and tower to suspend a "pigtail" or auxiliary cable from the endless cable so that a part on its lower end may be engaged with the upper end of the stand to swing it about the pivot axis of the cup between the mast and tower in response to movement of the cable back and forth about the sheaves. More particularly, the pigtail is so arranged that it is lifted as it winds about the sheave on the tower in order to raise the lower end of the stand from the cup, and lowered as it is unwound from about the sheave to lower the lower end of the stand onto the cup as the stand is moved into and out of a racking bay in the tower.

Problems have been encountered, however, in handling a stand of drill collars in this manner because the pigtail is not sufficiently strong to support its weight when not supported on the cup. Also, it has been difficult to move the lower end of the stand from the cup into a racked position in the setback tower.

It is therefore a further object of this invention to provide apparatus of this type having means for so transferring the drill collar stand which is strong enough to support drill collars and which simplifies movement of the stand into the tower.

Certain of the aforementioned patents show frames which permit tilting of the mast to different positions with respect to the vertical, and thus with respect to the tower. In some cases, however, the frame is of such construction that the tower provides no support for the tilted mast. In other cases, the frame is of a construction which is particularly unsuited to supporting a means for engaging and swinging the stand between the mast and tower.

It is therefore another object of this invention to provide apparatus of this type in which the frame is of such construction that the tower supports at least some of the weight of the mast, regardless of the extent to which the mast is tilted, and further in which the frame provides a convenient support for means which engages the upper end of the stand to swing it about a pivoted support for its lower end.

In the drawings, wherein like reference characters are used throughout to designate like parts:

FIG. 1 is a side elevational view of well drilling apparatus constructed in accordance with an illustrative embodiment of the present invention, and including a mast pivotally mounted on a base and tilted to a position for drilling a well at a slant with respect to the vertical, as well as a setback and racking tower mounted on the base in a substantially vertical position on the front side of the mast, and showing the front end of a pipe laydown device mounted on the base on the front side of the mast and beneath the tower;

Figure 1:
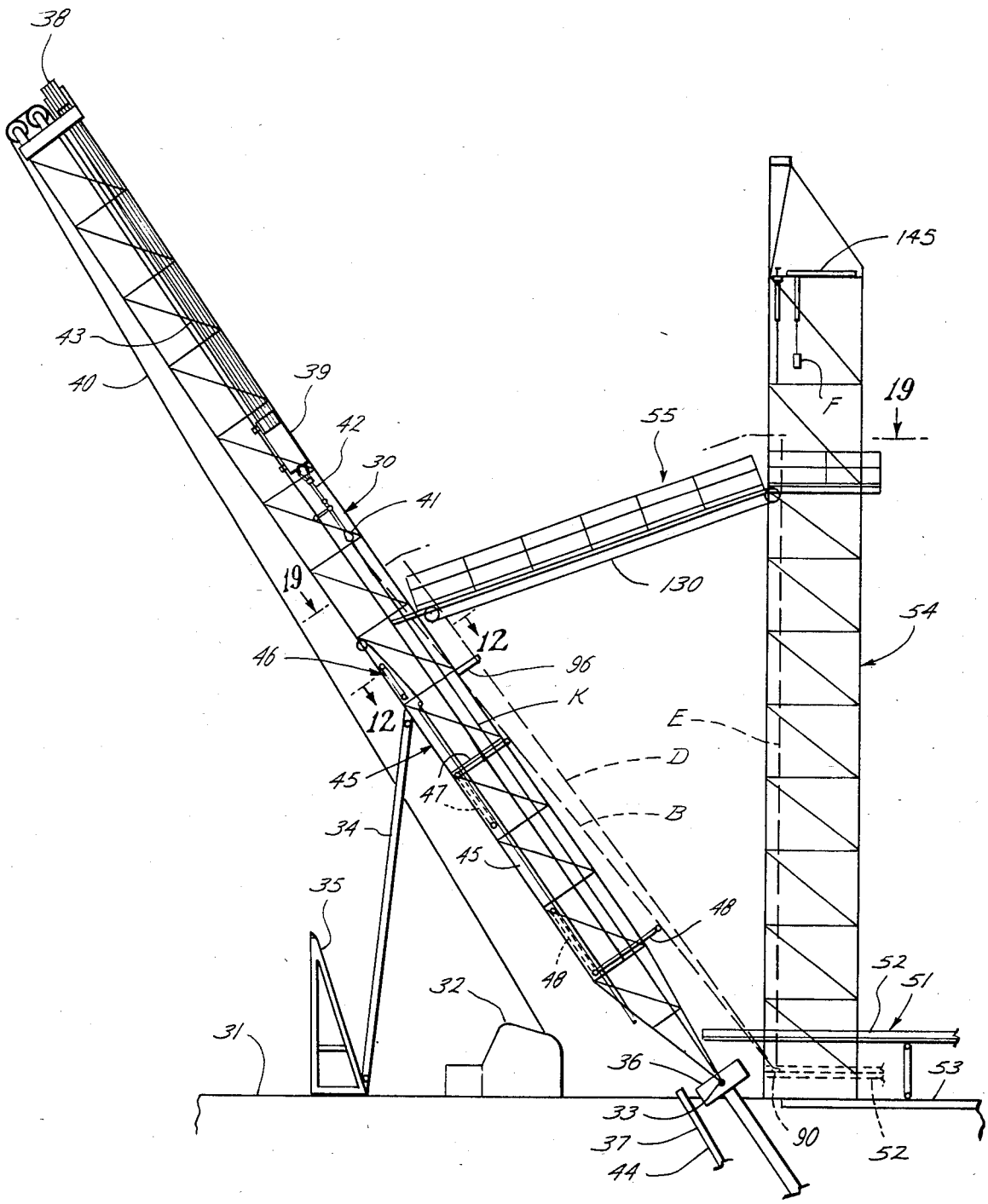
FIG. 1A is another side elevational view of the apparatus, including the lower ends of the mast and tower in broken lines, and with the elevator replaced by the swivel and the kelly suspended from the swivel connected to the upper end of a pipe joint in a mouse hole located behind the rotary table in the lower end of the mast.
FIG. 1B is a view similar to FIG. 1A, but after raising of the kelly with the swivel to lift the pipe joint from the mouse hole and lowering of the joint with the kelly onto the upper end of the drill string suspended in the rotary.
Figures 7, 8:
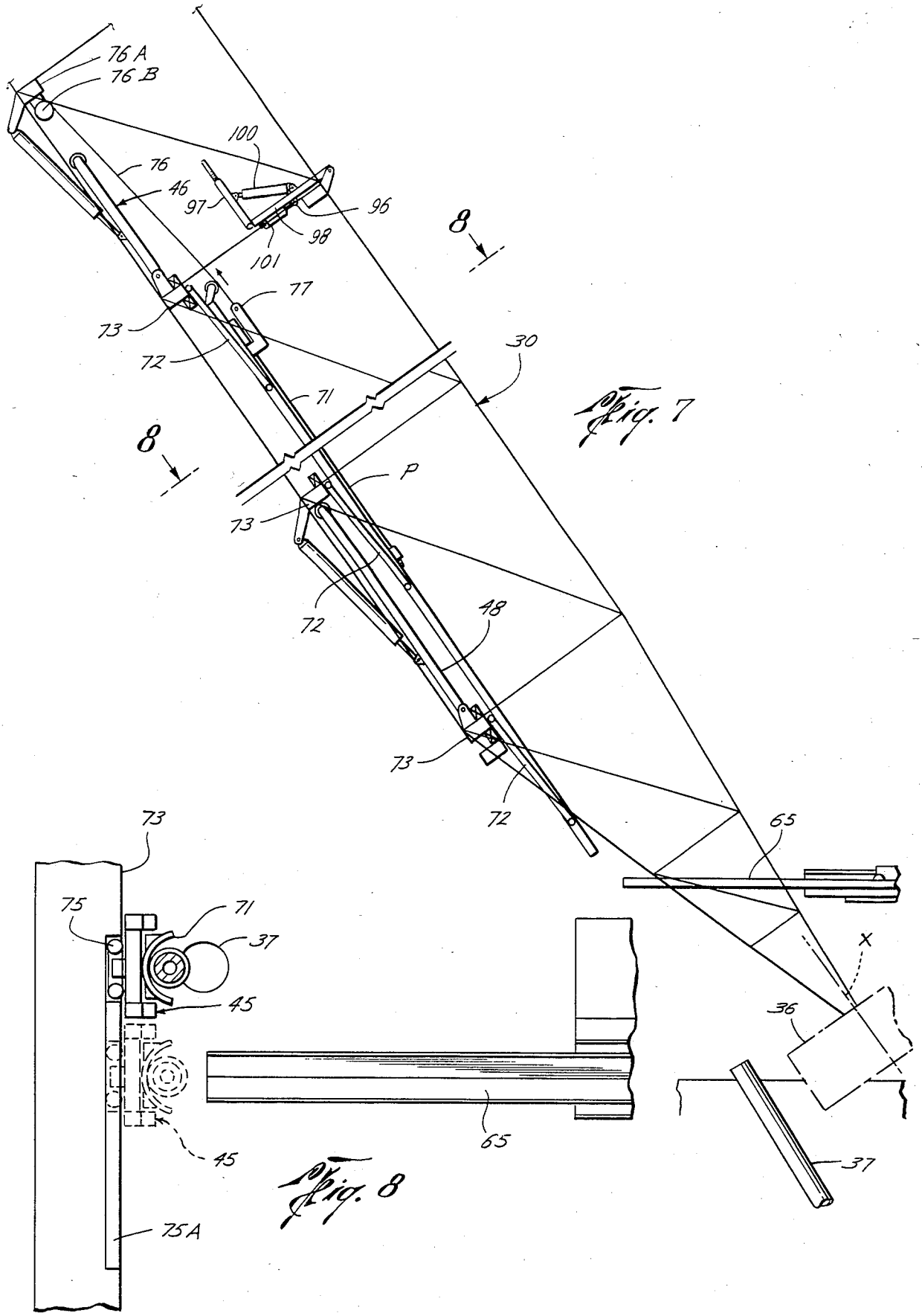
FIG. 7 is a side elevational view of the lower portion of the mast, on an enlarged scale, including and showing the front end of the trough moved further inwardly to a position near the back of the mast, and a pipe received on a pipe guide mounted on the mast following lifting of the pipe from the trough or prior to lowering of the pipe onto the trough.
FIG. 8 is a cross-sectional view of the mast, as seen along broken lines 8—8 of FIG. 7, and on a further enlarged scale, and showing the inner end of the trough adjacent the pipe guide and the pipe guide shifted from a broken line position in alignment with the trough to a solid line position in alignment with the mouse hole.
Figures 9, 10, 11:
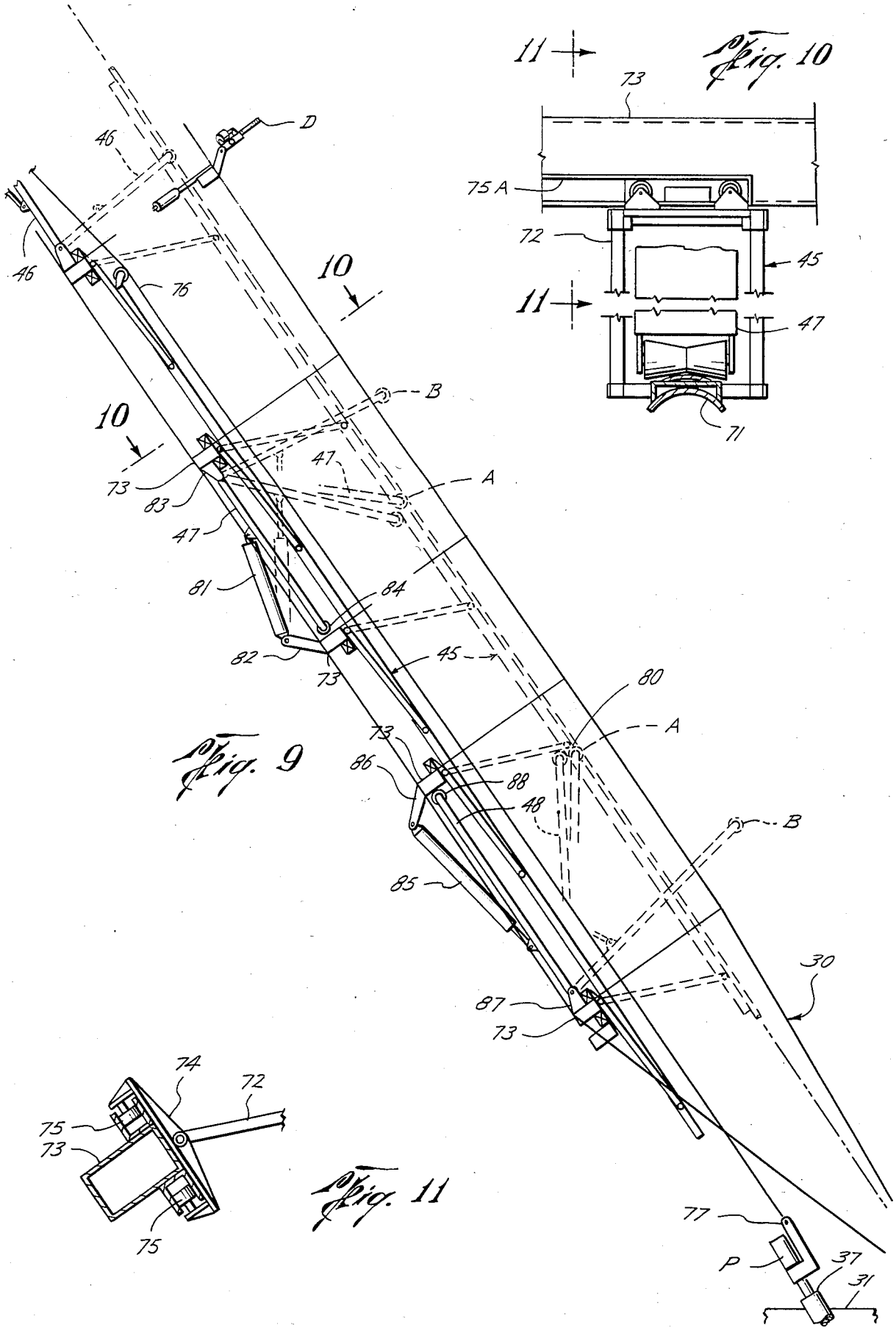
Figure 13:
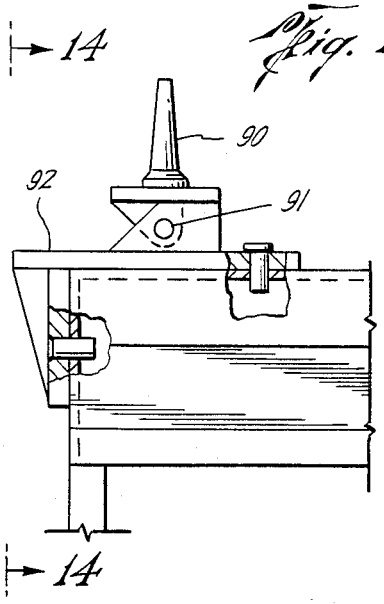
Figure 14:
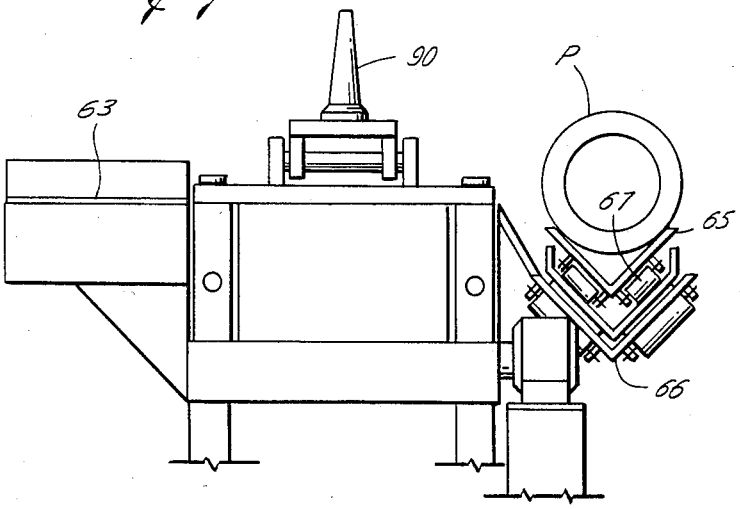
Figure 12:
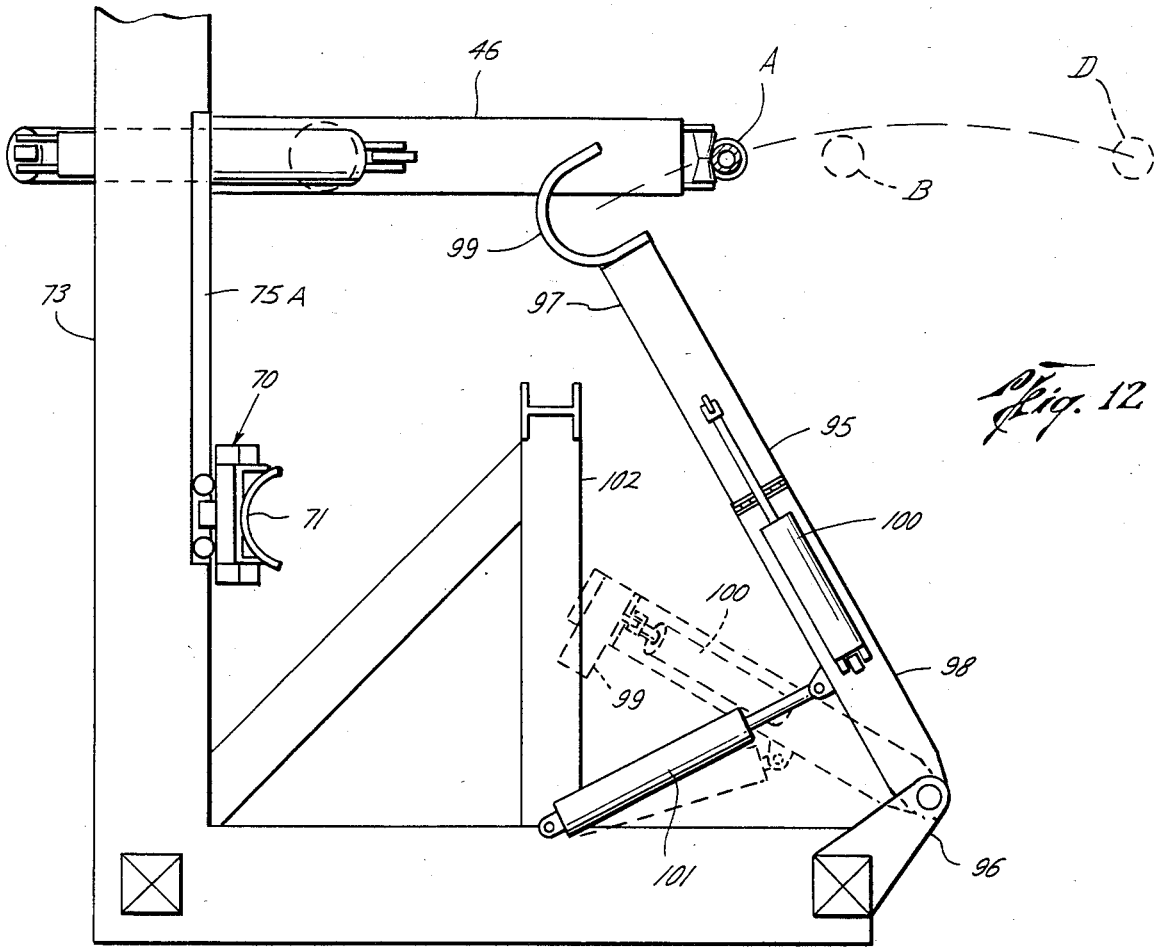
Figure 15:
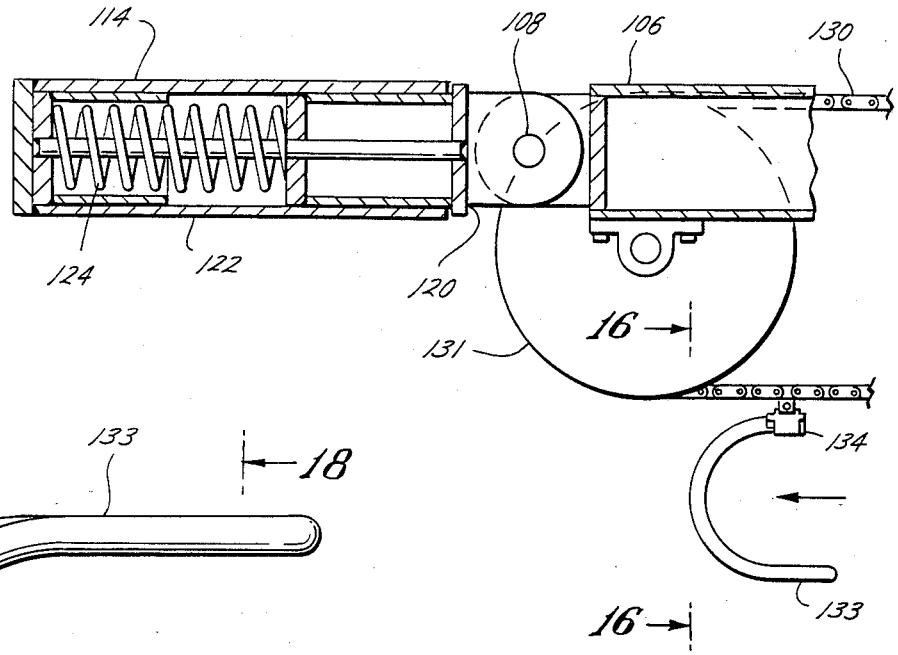
Figure 17:
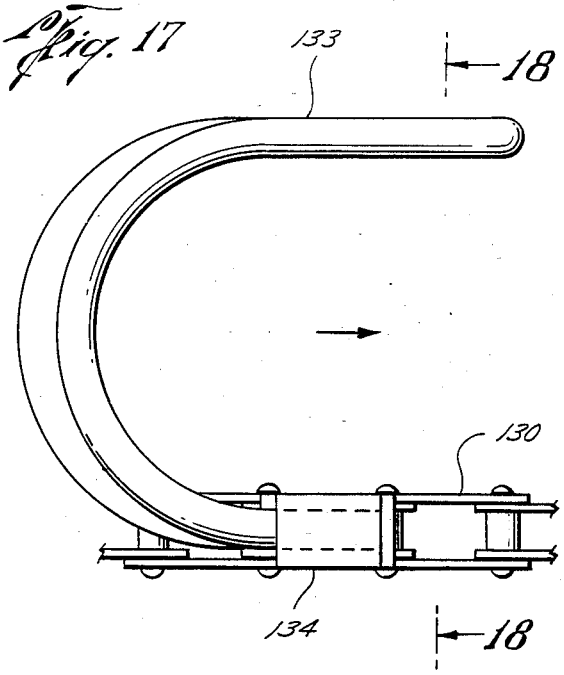
Figure 18:
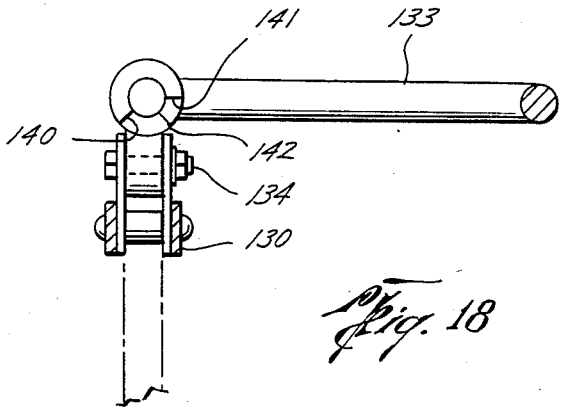
Figure 16:
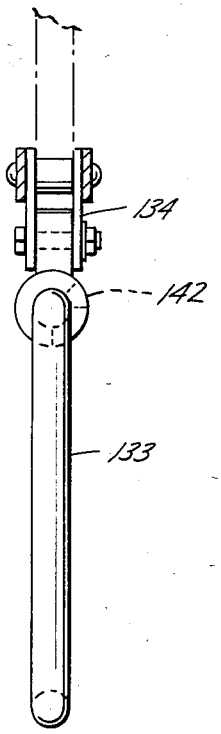
Figure 19:
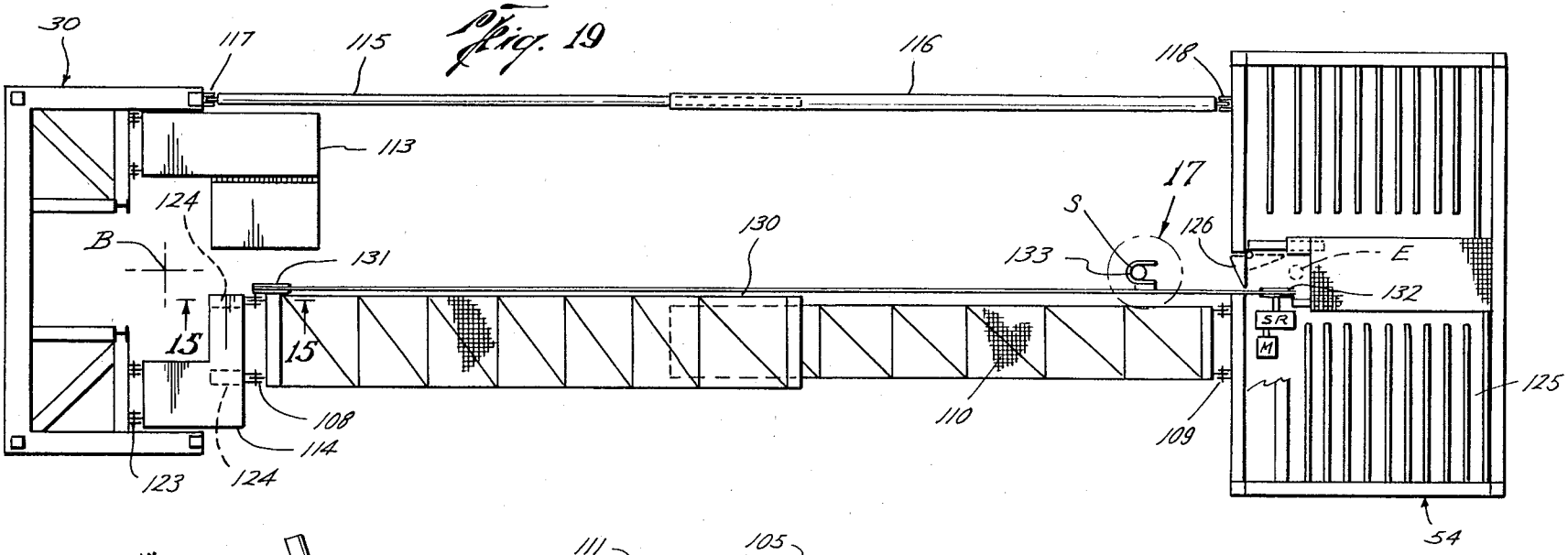
Figure 20:
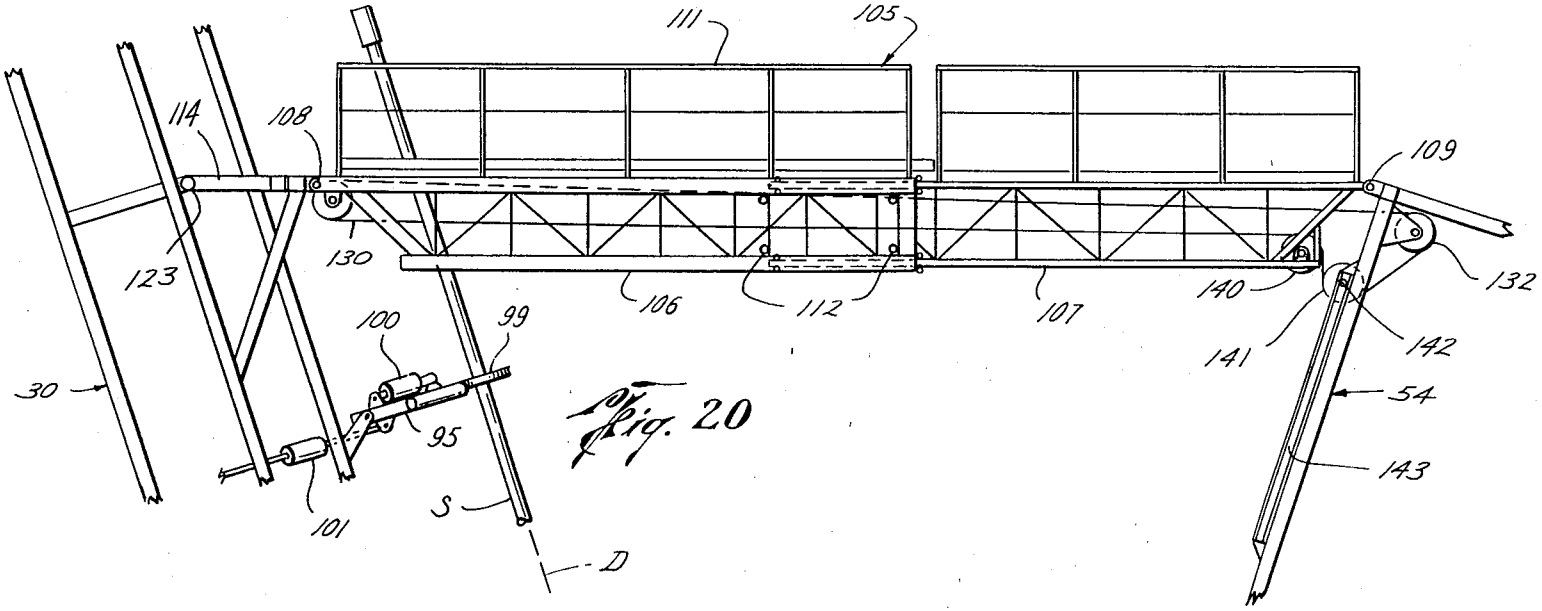

FIG. 9 is an enlarged side view of the lower end of the mast, similar to FIG. 7, but showing the upper end of a pipe supported in the mouse hole and indicating with broken lines various positions to which upper and lower centering arms as well as a kelly supporting arm on the mast may be moved from their solid line, retracted positions during transfer of a stand of pipe between the mast and the tower;

FIG. 10 is a vertical cross-sectional view of the mast, as seen along broken lines 10—10 of FIG. 9, and showing the upper centering arm swung to a position for moving the pipe guide outwardly away from the back of the mast to a position for guiding tools along the drilling axis;

FIG. 11 is a cross-sectional view of a portion of the mast, as shown along broken lines 11—11 of FIG. 10, to show the manner in which the pipe guide is mounted on a laterally extending member of the mast for shifting between the positions of FIG. 8;

FIG. 12 is a cross-sectional view of the mast, as seen along broken lines 12—12 of FIG. 1, and on an enlarged scale, and showing the pipe guide shifted to a position to the side of those shown in FIG. 8, during transfer of a stand of pipe, and showing an arm mounted on the mast for movement between a retracted broken line position and an extended full line position for picking up a stand of pipe after the stand has been moved from alignment with the drilling axis into position B, whereby it may be lowered onto the pin, and swinging the stand from position B to position D, whereby it may be picked up by means on a chain conveyor on the frame for swinging it on the pin into position E within the tower;

FIG. 13 is an enlarged detailed view of the front end of the laydown device, and showing the pin pivotally mounted on the pipe supporting member thereof in position to receive the lower end of the stand of pipe in the positions B, D and E of FIG. 1;

FIG. 14 is an end view of the laydown device, as seen along broken lines 14—14 of FIG. 13, showing the pin located on the center section of the pipe supporting member to align it with the carts thereon, and also showing a pipe mounted on the trough to one side thereof;

FIG. 15 is an enlarged sectional view of a portion of the mast and the end of the frame connected thereto, as seen along broken lines 15—15 of FIG. 19, and showing the front end of the chain conveyor mounted on a sheave on the front end of the frame as well as the pickup arm suspended from the chain;

FIG. 16 is an enlarged, front view of the lower flight of the conveyor and the pickup arm suspended therefrom, as seen along broken lines 16—16 of FIG. 15;

FIG. 17 is an enlarged detailed view of the top side of the chain conveyor and the pickup arm thereof, as indicated by the circled portion marked "17" in FIG. 19, and during movement of the pickup arm along the top flight of the conveyor in a direction to transfer a stand of pipe from the mast to the tower;

FIG. 18 is a cross-sectional view of the conveyor chain and pickup arm, as seen along broken lines 18—18 of FIG. 17;

FIG. 19 is a cross-sectional view of the apparatus, as seen from above the frame, and showing the pickup arm on the upper flight of the chain conveyor during movement in a direction to transfer a stand of pipe from the mast to the tower; and FIG. 20 is a side elevational view of the mast, tower and frame, as shown in FIG. 19, and also showing the kickout arm swung outwardly from the mast to engage and move a stand of pipe from the B position of FIGS. 1 and 12 to the D position thereof, and thus into a position in which the upper end of the stand of pipe will be engaged and moved toward the tower by means of the pickup arm on the chain conveyor.

With reference now to the details of the above-described drawings, the mast, which is indicated in its entirety by reference character 30, is shown in a tilted position above a drawworks 32 mounted on a base 31 to the back side of the mast. As in prior apparatus of this type, the lower end of the mast is pivotally mounted on the base for swinging about a horizontal axis 33, and is adapted to be moved to and from a tilted position by suitable hydraulic actuators (not shown) extending between the mast and the base, and when moved to tilted position, is supported at least partially by a longitudinally adjustable leg 34. A pedestal 35 on the base to the rear of the drawworks provides a means on which the mast may rest when lowered to a substantially horizontal position. As well known in the art, the substructure or base may be portable if onshore or an offshore platform.

Figure 1B:
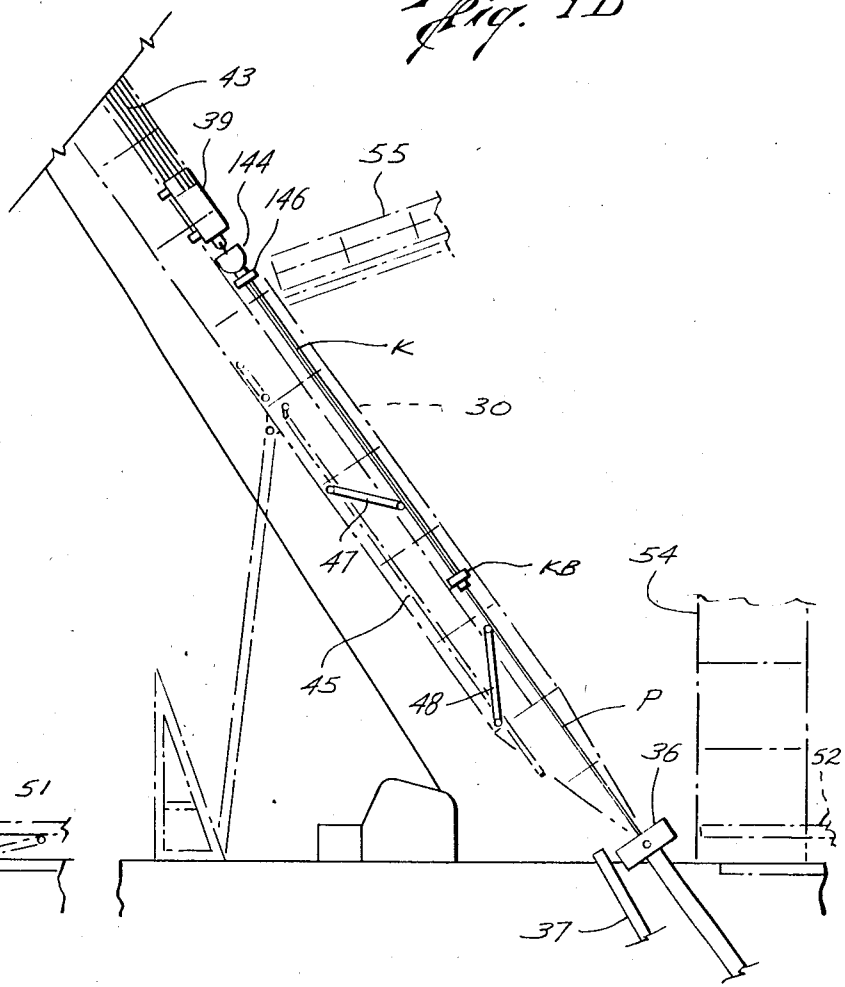
Figure 1A:
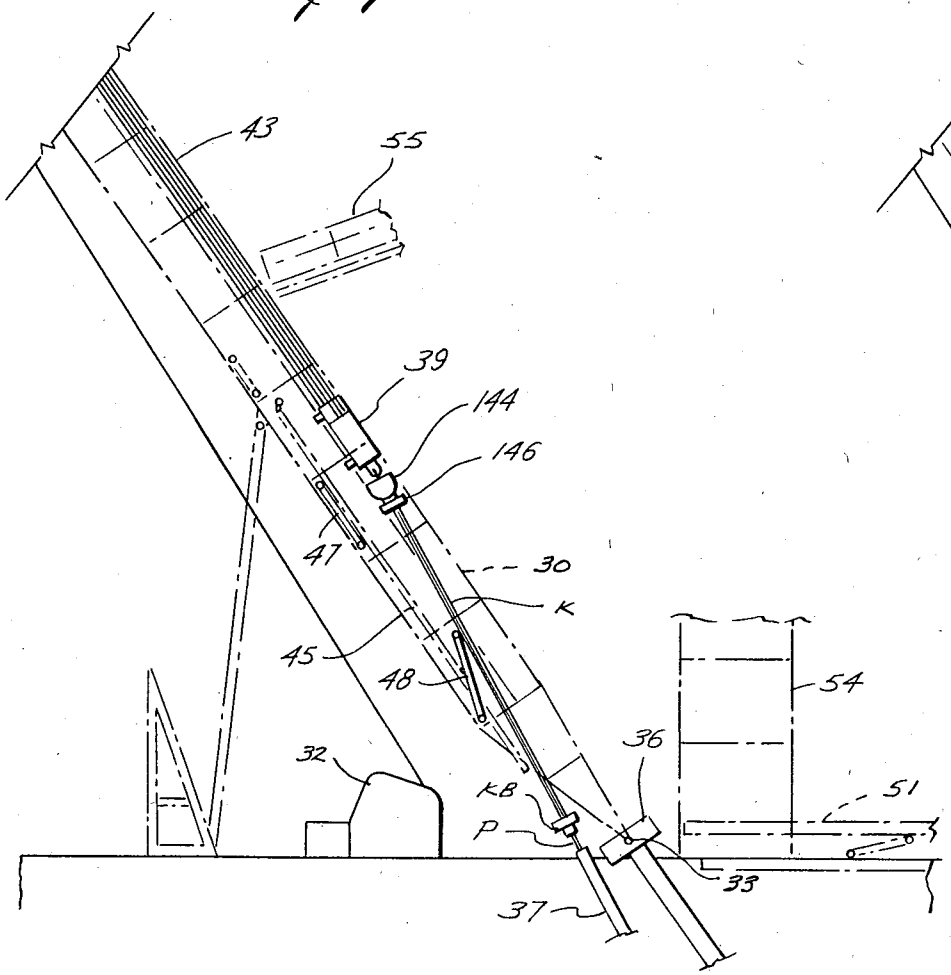

As is also common in apparatus of this type, a rotary table 36 is also mounted on the base for pivotal movement about the axis 33 so that its opening to receive the drill string may be aligned with the drilling axis "x" (FIG. 7) of the mast and thus with conductor casing extending into the subsurface beneath the base. The mast includes a crown block 38 at its upper end, a traveling block 39 suspended by means of fast line 40 extending between the drawworks and the crown block, and cables 43 extending between the crown block and traveling block so that the latter may be raised and lowered within the mast. As shown in FIG. 1, an elevator 41 is suspended by links 42 from the traveling block for pivoting with respect thereto and is of such construction as to permit it to be releasably connected to the upper end of a pipe disposed within the drilling axis. As well known in the art, and as shown in FIGS. 1A and 1B, during drilling of the well, the elevator is replaced by a swivel 144 which is also pivotally connected to the block 39 and a kelly k suspended from the swivel. Thus, upon connection of the kelly to the upper end of the drill string, the string may be rotated by means of a kelly bushing KB in the rotary table 36. Suitable means may also be provided on the traveling block, elevator links and the swivel for guided movement along tracks extending longitudinally of the mast, whereby the traveling block, links and swivel are constrained to move in the drilling axis. As also well known in the art, a kelly spinner 146 is conventionally mounted on the swivel.

As also shown in FIG. 1, a mouse hole 37 extends downwardly from the base behind the rotary and generally within the plane in which the mast tilts. More particularly, the mouse hole is pivotally mounted on the base in any suitable manner (not shown) to permit it to be swung into a position generally parallel to the drilling axis through the rotary table.

As previously mentioned, and as will be described in more detail to follow, a pipe guide, which is indicated in its entirety by reference character 45, is mounted on the mast toward its rear side for shifting laterally of the mast between a position aligned with the pipe trough of the laydown device, and a position aligned with the mouse hole 37 and the drilling axis X (FIG. 7) of the rotary. As will also be described in detail to follow, the mast includes a kelly centering arm 46 is pivotally mounted on the upper end of the mast above the pipe guide for movement between a retracted position (solid lines in FIGS. 1, 7 and 9) and an extended position (broken lines in FIGS. 1 and 9), as well as upper and lower centering arms 47 and 48 which are also mounted on the mast for swinging between retracted positions, as shown in solid lines in FIGS. 7 and 9, and extended positions, as shown in broken lines in various positions, all for purpose to be described.

Figure 6:
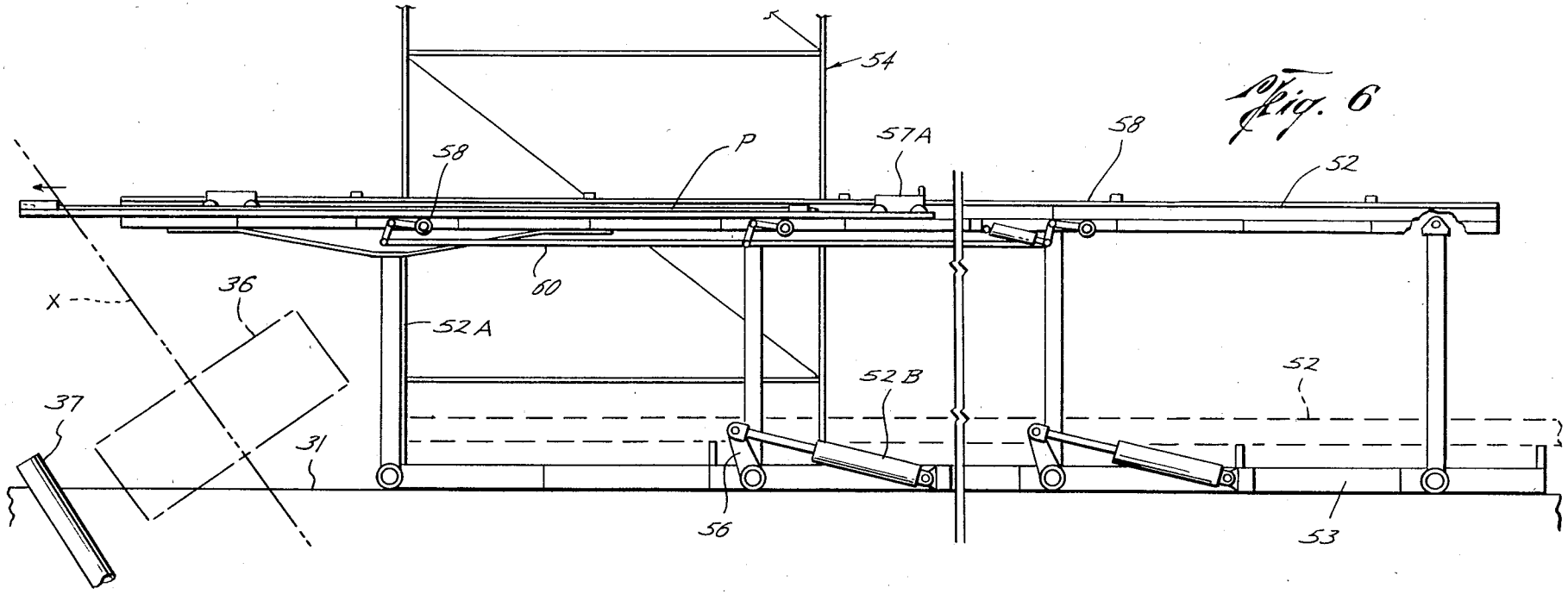
FIG. 6 is a side elevational view of the device similar to FIGS. 2 to 4, but upon raising of the pipe supporting member, as shown in FIG. 1, and rolling of the trough forwardly along the member to move the front end of the pipe into the mast.

The laydown device, which is indicated in its entirety by reference character 51, includes an upper pipe supporting member 52 mounted on a lower member 53 within the base 31 for movement between the lower position shown in broken lines in FIG. 1 and the raised position shown in solid lines in FIG. 1 as well as in FIG. 6. As previously described, and as will be described in more detail to follow, when the upper pipe supporting member is raised its front end is also moved forwardly into the lower end of the mast generally above the rotary table, as shown in FIGS. 1 and 6.

The setback pipe racking tower, which is indicated in its entirety by reference character 54, is mounted on the base 31 above the front end of the laydown device and with its open side facing the open, front side of the mast. As also shown in FIG. 1, and as will be described, a frame 55 extends between and is pivotly connected at its opposite ends to the mast and tower so as to provide a walkway between them as well as a means through which a stand of pipe may be transferred between the broken line position D of FIG. 1 and the position E thereof, in which latter position it is disposed within the tower, and thus in a position to be manipulated by means of an elevator F mounted in the upper end of the tower above the racking bays of the tower. As will also be described, a means is supported from the frame for engaging the stand of pipe, as its lower end is supported as previously described, to swing it about the pivot axis of the support between positions D and E.

Figure 2:
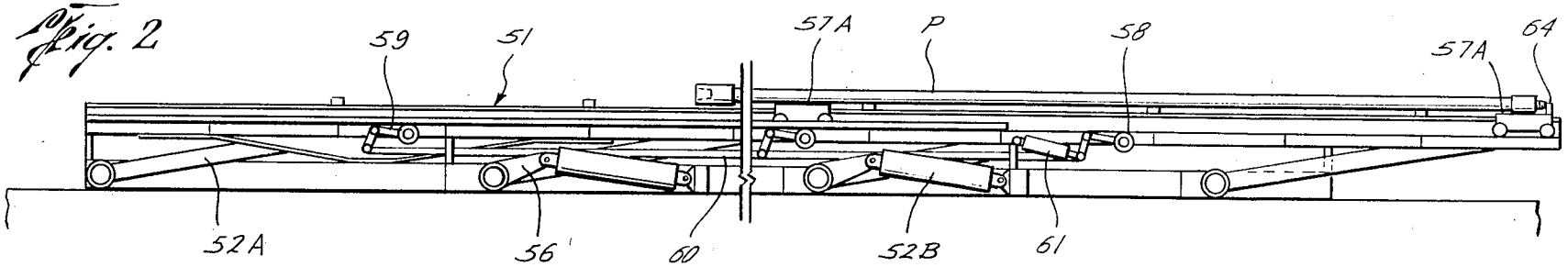
FIG. 2 is a side elevational view of the laydown device, on an enlarged scale and interrupted intermediate its length, and with an upper pipe supporting member thereof in a lowered position and a pipe from a pipe storage rack on one side of the device rolled onto carts on a center section of the member.
Figure 3:
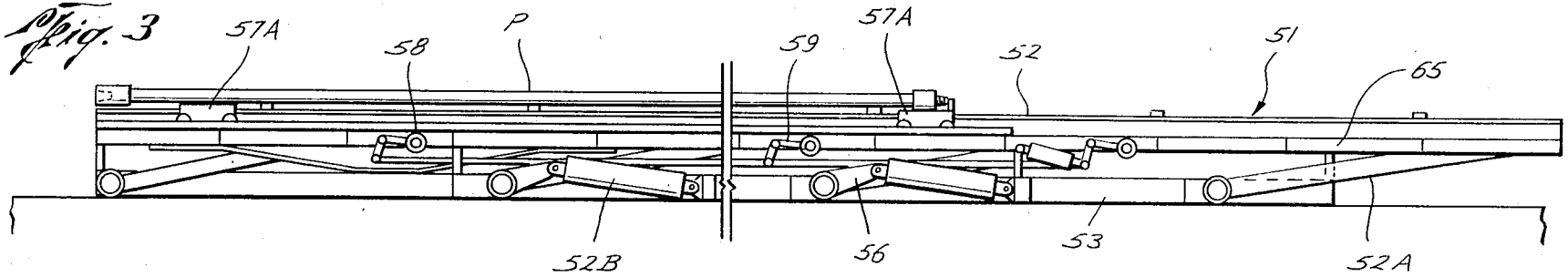
FIG. 3 is a view of a laydown device, similar to FIG. 2, but upon movement of the pipe on the carts along the upper pipe supporting member to the front end of the device.
Figure 4:
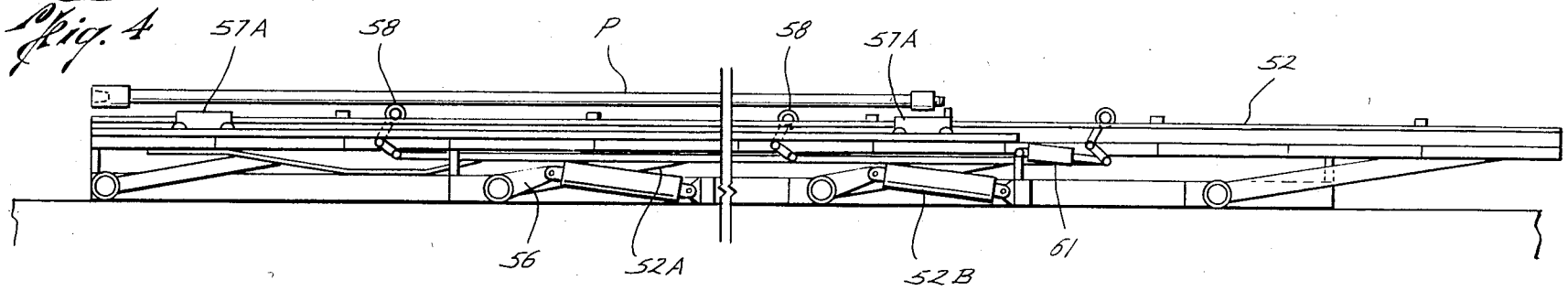
FIG. 4 is another view of the device similar to FIG. 3, but during shifting of the pipe from a center of the pipe supporting member onto a trough mounted on the upper pipe supporting member to one side of the center section of the pipe supporting member.

As shown in FIGS. 2 to 6, the upper pipe supporting member 52 and base member 53 of the laydown device 51 are connected by struts 52A pivotly connected to the upper and lower members and adapted to swing in a counterclockwise direction from the generally horizontal positions of FIGS. 2–4 to the generally vertical positions of FIG. 6 in order to raise the upper member 52 from the lower position of FIGS. 2–4 to the upper position of FIG. 6. More particularly, the struts are so moved by means of one or more fluid actuated extendable and retractable actuators 52B pivotly connected between the base member and crank arms 56 connected to the lower ends of the struts 52A, so that, as would be understood from the drawings, the actuators may be extended to swing the crank arms in a counterclockwise direction and thus raise the struts 52A. Obviously, retraction of the actuators will in turn swing the struts in a clockwise direction so as to also swing the crank arm 56 clockwise and thereby move the upper member 52 to its lower position.

Inasmuch as the struts swing upwardly and counterclockwise in raising the upper member, the front end of the upper member will, when raised, move to the left or forwardly toward the front side of the mast. Thus, as shown in FIG. 6, when fully raised, the front end of the upper member is near the drilling axis X and above the rotary and mouse hole. As shown in FIG. 6, the upper pipe supporting member 52 includes a center section 57 having rails along its opposite longitudinally edges over which pipe carrying carts 57A are adapted to move in a direction longitudinally of the device. More particularly, the tracks which support the carts are on opposite sides of rollers 58 which are carried by crank arms 59 connected to a linkage 60 extending longitudinally of the device to connect with a hydraulic actuator 61 connected to the center section. Thus, upon the extention of the actuator, the rollers 58 are raised from the position shown in FIGS. 2 and 3, wherein their upper sides are beneath the top side of the center section, to the position of FIG. 4 in which the rollers are above the top side of the center section.

Figure 5:
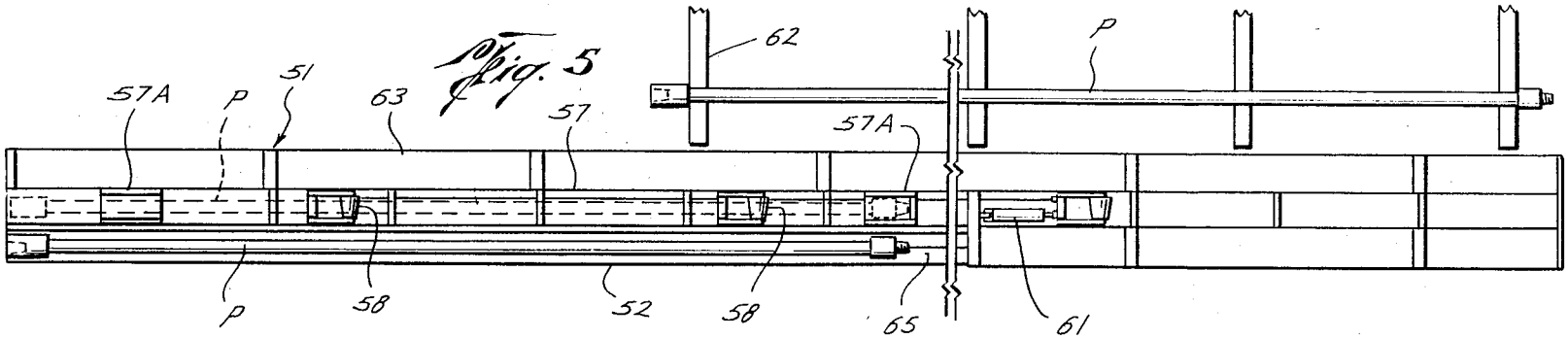
FIG. 5 is a top plan view of the laydown device of FIGS. 2 to 4, and showing the pipe after having been shifted into the trough.

As shown in FIG. 5, joints of drill pipe P are adapted to be mounted on a pipe storage rack 62 whose inner side is adjacent the device on substantially the same level as a support surface 63 on one side of the center pipe section 57 in the lower position of member 52. More particularly, the carts 57A on the center section of the member are positioned to receive the pipe toward its opposite ends when the latter is moved from the pipe rack and over the surface 63. As shown in FIG. 2, the rear or pin end of drill pipe P is adapted to abut a stop 64 on the rear cart when the pipe is supported rearwardly of its box end by means of the other cart 57A, so that, as shown in FIGS. 2 and 3, the pipe may be moved forwardly with the carts from the rear to the front end of the laydown device.

The device also includes a V-shaped trough 65 which, as best shown in FIG. 14, is carried within a V-shaped section 66 of the supporting mechanism to the side of the center section 57, opposite the surface 63. More particularly, as also shown in FIG. 14, rollers 67 on the bottom sides of trough 65 permit it to be rolled longitudinally with the section 66 toward and away from the mast.

With the pipe mounted on the carts and the carts at the forward end of the device as shown in FIG. 3, actuators 61 are extended so as to raise rollers 58, as shown in FIG. 4, and thereby kick the pipe over from the carts onto the trough 65, as shown in FIG. 5. For this purpose, the rollers are tapered in a direction toward the trough so as to move the pipe in the proper direction. When, however, pipe is being laid down—i.e., removed from the drill string and returned to the pipe rack 62—the rollers 58 may be reversed end for end so that when the pipe is moved from the mast onto the carts 57A, and the carts moved rearwardly from the positions of FIG. 3 back to the position of FIG. 2, and thus to a position laterally opposite the pipe rack, the rollers 58 raised to kick the pipe over onto the surface 63 and thus enable it to be returned to the rack.

When the pipe has been kicked over into the trough 65, as shown in FIG. 5, actuators 52B are extended to lift the upper member 52 of the laydown device, and thus lift the trough 65 upwardly and forwardly by the drilling axis X, as shown in FIG. 6. At this time, the trough 65 may be moved forwardly over the rotary 36 and to position its front end adjacent to the mouse hole 37, as shown in FIG. 8.

As best shown in FIGS. 7 and 9, the pipe guide 45 includes an elongate arcuate member 71 mounted on the rear side of the mast by means of arms 72 pivotally connected at their opposite ends to lateral braces 73 of the mast (see FIG. 11) and the sides of a base 70 for the arcuate member 71 (see FIG. 10). As shown in FIG. 7, the arcuate member is of a length long enough to support at least one joint of pipe P, whether for the purpose of moving the pipe from the laydown device into the mast preparatory to installing it in the drill string, or for the reverse operation moving the drill pipe from the mast back to the laydown device.

As also shown in FIGS. 7 and 9, a winch 76B is mounted on a bracket 76A carried by the pipe guide, and the free end of winch line 76 carries a clamp or collar 77 adapted to be removeably disposed about the pipe P beneath the tool joint at its upper end. In the process of drilling a well, the winch line 76 is let out until the clamp 77 has been lowered to a position in which it may be locked about the tool joint on the front end of pipe P carried on the trough 65. Then, the winch line 76 may be taken up in order to lift the front end of the drill pipe from the trough 65 and upwardly and rearwardly with respect to the mast. As this occurs, the rear end of the pipe will move toward the front end of the trough, and thus to a position close to the lower end of the pipe guide. When the pipe has been drawn onto the guide, and its lower end lifted from the trough, the trough and upper supporting member of the laydown device are returned to their lower positions, and the carts are moved to the rearward positions, as shown in FIG. 2, and thus to positions in which they are ready to receive another drill pipe P from the rack 62.

As shown in FIG. 11, the arms 72 of the pipe guide 45 are connected to brackets 74 carrying rollers 75 on flanges at their upper and lower ends for rolling engagement within guideways 75A formed on the upper and lower sides of the braceses 73. More particularly, the guideways 75A extend in a lateral direction to enable the pipe guide to be shifted laterally between the broken line position of FIG. 8, wherein the arcuate member 71 is longitudinally aligned with the trough 65 and the solid line position of FIG. 8, wherein the member 71 is longitudinally aligned with the mouse hole and the drilling axis as well as the out of the way position of FIG. 12 when a pipe stand is being transferred between the mast and the tower.

When the pipe joint P has been drawn upwardly into the pipe guide, as shown in FIG. 7, the pipe guide is shifted laterally to the solid line position of FIG. 8 to dispose the pipe in general alignment with the mouse hole 37. Winch line 76 is then let out in order to lower the pipe P by means of clamp 77 until its lower end enters the mouse hole and further until the pipe is lowered into a fully supported position within the mouse hole as shown in FIG. 9. At this time, the clamp may be released from the pipe and the pipe guide 45 may be shifted back from the solid line position to the broken line position shown in FIG. 8 and thus into position to receive another joint of drill pipe P from the trough 65 of the laydown device.

With the upper end of the drill string supported by slips in the rotary, the kelly may be disconnected from its upper end and lifted with the swivel 144 by the traveling block. At this time, the centering arm 48 is extended to move rollers on its outer end into the broken line position "A" of FIG. 9 near the drilling axis, and thus to support the kelly as its lower end clears the upper end of the drill string. For this purpose, an extendable and retractable actuator 85 is pivotally connected between a bracket 87 on one of the braces 73 of the mast and an intermediate portion of the arm 48 intermediate its pivotal connection at one end to a bracket 86 on the next lower brace 73 and roller 88 on the outer end of the arm 48. Thus, the actuator 85 may be extended to swing the roller on the actuator upwardly and outwardly until it engages the kelly 80.

In some instances, such as during the handling of casing, it may be necessary to also extend the upper arm 47 to position "A". Thus, an actuator 81 is connected at one end to bracket 82 on the next upper frame member 73 and an intermediate portion of the centering arm 47 between is lower end pivotally connected to a bracket 83 on the next upper frame 73 and roller 84 on the end of arm 47. Thus, the actuator 81 may also be extended to move roller 84 on the upper centering arm to be the broken line position A shown in FIG. 9.

Thus, the kelly is maintained in alignment with the drilling axis X as it is raised from the upper end of the drilling string, following which the centering arm 48 is retracted to the position shown in FIG. 1A to permit the kelly to be swung from its pivotal connection to the swivel 144 at the lower end of the traveling block into alignment with the mouse hole 37. The traveling block is then again lowered to stab the lower end of the kelly into the upper end of a pipe joint supported in the mouse hole, and the joint between the lower end of the kelly and the upper end of the pipe in the mouse hole may be torqued up adjacent the floor of the base, whereby the drill pipe is securely supported from the kelly upon lifting of the kelly and the pipe from the mouse hole.

As the kelly and pipe joint are raised with the traveling block, from the position of FIG. 1A, the centering arm 47 is extended to support the kelly so that the centering arm 48 may be retracted out of the way of the kelly bushing. As the kelly bushing passes the centering arm 48, it is extended to engage the drill pipe suspended from the lower end of the kelly and the arm 47 is retracted to its solid line position. When the lower end of the drill pipe clears the mouse hole, and the centering arms 47 and 48, as shown in FIG. 1B, (the "A" positions shown in FIG. 9) so as to align the drill pipe suspended from the kelly with the drilling axis X of the mast and thus the upper end of the drill string supported in the rotary.

At this time, the kelly and drill pipe are lowered with the traveling block to stab the lower end of the pipe P into the upper end of the drill string, as shown in FIG. 1B and permit it to be made up with the drill string by suitable apparatus for applying torque thereto at the base 31. The traveling block is then again raised to permit the slips supporting the drill string from the rotary to be removed, and the drill string, including the kelly and the newly added drill pipe is then lowered by means of the traveling block to the lower end of the well bore, and the rotary drilling process is continued until it has reached a depth at which another pipe joint must be added to the drill string.

Turning now to the procedure by which stands of pipe may be transferred between the mast and the tower during "tripping", it will be assumed that the drill string is supported by slips within the rotary table, as previously described, and that the swivel 144 has been removed and replaced by elevator 41. At this time, the traveling block is lowered to permit the elevator to be latched about the upper end of the drill string, and the block is then raised until the lower end of the stand of pipe, which may consist of two or three joints of drill pipe or drill collars, has cleared the rotary table. At this time, slips are set in the rotary table about the upper end of the joint of pipe just beneath the stand, and the traveling block is lowered to support the remainder of the drill string from the slips.

At this time, the centering arm 48 is extended to the position indicated at A in FIG. 9, so as to support the stand of pipe in alignment with the drilling axis X. At this time, torque is applied to the lower end of the stand to break it out from the upper end of the upper joint of pipe of the drill string suspended in the rotary, and the block is then raised until the lower end of the stand of pipe clears the upper end of the drill string. The centering arm 48 is then extended further to the B position shown in solid lines in FIG. 1 and broken lines in FIG. 9 in order to swing the stand of pipe from the solid line position A of FIG. 1 to the B position of FIG. 1.

In this latter position, the stand of pipe is aligned with the axis of a support pin 90 pivotally mounted by means of pin 91 to a bracket 92 releasably mounted on the upper side of the inner end of the center section of the pipe supporting member of the laydown device, as shown in each of FIGS. 13 and 14. Thus, as will be understood from FIG. 1, when the pipe supporting member of the laydown device is in its lower position, as shown in broken lines in FIG. 1, the support pin 90 is within the upright tower near the open side thereof facing the open front side of the mast. When the stand is in this position, and while the pipe stand is supported by the centering arms 47 and 48, as shown in FIG. 1, the traveling block may be lowered to move the lower end of the stand onto the pin so that it is supported thereby.

As previously described, and as best shown in FIG. 12, a kickout arm 95 is pivotally mounted at one end on a bracket 96 carried by a side of the mast near its open side. The arm 95 comprises inner and outer ends 97 and 98 which are hinged together to permit them to be swung between positions in alignment with one another and positions arranged at right angles to one another, as shown in FIG. 7. The inner end 97 of the arm is pivotally connected to the bracket 96, while the outer end 98 of the arm carries a pickup finger 99 which is of arcuate shape and which, when the ends of the arm are aligned, as shown in FIG. 12, faces away from the mast and toward the tower.

The inner and outer ends of the arm are moved between alternate positions by means of an hydraulic actuator 100 pivotally connected at its opposite ends to intermediate portions of the ends of the arm. In addition, an hydraulic actuator 101 is pivotally connected at its opposite ends to the side of the mast and to an intermediate portion of a side edge of the inner end 98 of the arm. As indicated in FIG. 12, the actuator 101 may be extended from its retracted position (broken lines) to swing the arm in a clockwise direction to the solid line position. When the arm is not in use, both actuators 100 and 101 are retracted so as to swing the outer end 97 of the arm to its upright position, as shown in FIG. 7, and swing the arm as a whole in a counterclockwise direction, as shown in broken lines in FIG. 12, so that its pickup arm 99 is out of the way of other operations being performed during the transfer procedure and protected from damage by the drill string, the traveling block or other parts of the apparatus previously described by means of a brace 102 on the mast.

During breakout of the lower end of the stand of pipe from the drill string, as above described, the kickout arm 95 has been extended to the solid line position shown in FIG. 12, wherein the open side of its finger 99 is generally behind the stand of pipe held within the drilling axis by means of the extended centering arm 47, as indicated at A in FIG. 12 and as shown in broken lines in FIG. 1. At this time, the following further extension of arms 47 and 48 to the "B" positions of FIG. 9, the elevator is unlatched from the stand of pipe, and the actuator 101 is extended further from the position shown in FIG. 12 so as to swing the finger 99 in a clockwise direction. As the arm is swung in this manner, the finger will engage the upper end of the stand of pipe which is supported at its lower end on the pin 90, and swing it in a clockwise direction from the position shown at B in FIG. 12 to position D shown in FIG. 12 as well as in FIG. 1. At this time, the stand of pipe is positioned for engagement by a pickup arm of the conveyor apparatus, as will be described to follow, and the traveling block may, upon unlatching of the elevator, be lowered for makeup with the upper end of the next stand of pipe supported in the rotary.

FIG. 10 shows the manner in which the pipe guide 71 may be moved outwardly by the centering arms 47 and 48 when the pipe guide is in the position indicated in solid lines in FIG. 8 wherein it is aligned with the axis of the mouse hole and the drillng axis of the mast, which might be useful for example in guiding certain tools into and out of the drilling axis. These extended positions of the arms are shown in broken lines in FIG. 9 just to the left of the broken line positions "A". Thus, as shown in FIG. 10, extension of the centering arms cause the rollers on their outer ends to engage the back side of the arcuate support surface 71 of the guide and swing it outwardly on the arms 72 to dispose it within the drilling axis.

As best shown in FIGS. 19 and 20, the frame which is adapted to connect the mast and tower, and which is indicated in its entirety by reference character 105, comprises inner and outer telescopically arranged sections 106 and 107. Thus, the free end of the inner section 106 is pivotally connected to the mast by means of a pin 108, and the free end of the outer section 107 is pivotally connected to the tower by means of pivot pins 109. As best shown in FIG. 19, each section of the frame includes a walkway 110 having handrails 111 to permit personnel to move back and forth between the tower and the mast. Also rollers 112 (see FIG. 20) are mounted on one section for riding within a track on the other.

This frame construction enables its effective length to be changed, as the mast is moved between different tilted positions without disconnecting their free ends from the mast and tower. Then, when the mast has been moved into its desired position, the frame sections are locked against further extension and retraction by pins adapted to fit within aligned holes in the telescoping ends of the sections. As shown in FIG. 19, the frame also includes telescopically arranged rods 115 and 116 pivotally connected at their free ends to the mast and tower by means of pins 117 and 118. As shown in FIG. 19, the rods are spaced from the walkway sections to form a slot through which the pipe stand may be swung.

As shown in FIG. 19, the mast includes platforms 113 and 114 arranged to permit personnel to stand within the mast adjacent the end of the frame. As shown in FIG. 19, the inner sides of the platforms are spaced apart a distance sufficient to permit the stands of pipe to be swung therethrough into and out of the B position shown in FIG. 19 as well as in FIGS. 1 and 12.

As best shown in FIG. 15, the platform 114 is made up of telescoping sections, with the inner section 120 being connected to pivot pins 108 and thus to the frame and the outer section 122 being pivotally connected to the remainder of the frame by means of pivot pins 123 (see FIG. 19). More particularly, a pair of coil springs 124 are compressed between oppositely facing walls of the sections of the platform 114 so as to yieldably urge the platform section 120, and thus the frame section 106, to the right so as to cushion shock loads on the frame.

The tower 54 is of more or less conventional construction in that it has bays 125 extending laterally from opposite sides of an open center section facing its front side to receive the upper ends of stands of pipe. Thus, the stand of pipe is moved by means of the conveyor mechanism to be described into and out of the dotted line position E shown in FIGS. 1 and 19, and thus through a gate 126 across the opening into the front side of the tower. With the stand of pipe in this position, its lower end may be raised from the pin 90 by means of the elevator F on the mast, as shown diagrammatically in FIG. 1, and the elevator then moved along a track 145 on the tower to swing the stand toward the rear of the tower and into a selected one of the bays 125. At this time, of course, the elevator F may be released from the stand of pipe and returned to the position shown in FIG. 1. Obviously, a stand may be removed from a bay and returned to position E preparatory to being swung back to the mast by a reversal of this procedure.

As previously described, and as shown in the drawings, an endless chain 130 is disposed about sheaves 131 and 132 mounted on the sides of the frame adjacent its opposite ends. As will be described to follow, the conveyor chain is maintained taut, regardless of the effective length of the frame, and thus the tilt of the mast, and a pickup finger 133 is carried thereby in such a manner as to engage a stand of pipe held in position D, as previously described in connection with FIG. 12, and swing it about the pivot axis of pin 90 and toward the tower as the finger moves about the sheave 131 and with the upper flight of the chain in a direction toward the tower. Thus, the pickup arm 133 is disposed above the kickout finger 99 which has moved the stand to position B, so that the stand of pipe is merely transferred from the finger 99 to the finger 133. Of course, when the stand of pipe has been transferred to the pickup finger 133, the kickout arm 95 may be moved back to its retracted position, as shown in broken lines in FIG. 12, preparatory to its moving a subsequent stand from the position B to the position D.

As shown in FIGS. 15 to 18, the pickup arm 133 is suspended from the chain 130 by means of a swivel connection 134 of such construction that, as the finger 133 moves with the lower flight of the chain, it will be suspended in a vertical position therefrom. However, as the finger and the swivel connection 134 move about the sheave 131 for movement to the right, with the upper flight of the chain, the pickup arm will swing laterally into a horizontal position, as shown in FIG. 17, wherein it extends from the inner side of the chain for movement along the inner side of the frame as it approaches the stand in position D. For this purpose, and as shown in FIG. 18, the end of the finger 133 has shoulders 140 and 141 formed thereon in a position to swing between positions engaged with opposite sides of a lug 142 carried by the swivel connection depending on its position with respect to the chain.

As will be appreciated, in order to transfer a stand of pipe from the tower to the mast, the position of the the swivel connection 134 with respect to the chain is reversed so that the finger opens to the left, and the direction of movement of the chain is reversed, so that, as the finger and swivel move about sheave 132, the finger will assume a position to pick up a stand and swing it through the throat on the open side of the tower 54, and thus into a position in which it will be transferred to the finger 99 which has moved into the solid line position of FIG. 12 to receive it. Then of course the kickout arm need only be retracted, and the various parts of the mast manipulated, as previously described, to reverse the entire procedure—i.e., permit the stand of pipe to be moved back into the drilling axis X and lowered into connection with the upper end of the drill string suspended by slips from the rotary.

The chain is maintained taut by means of an idler 140 mounted on the frame in position to engage its lower flight to guide it to and from another idler 141 intermediate the idler 140 and the sheave 132 and having a pin 142 adapted to slide within a track 143 mounted on the tower 54. Thus, the idler 141 is free to move upwardly or downwardly within the track 143 to adjust to changes in the effective length of the frame.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Well drilling apparatus, including a base, a mast pivotally mounted on the base for swinging about a horizontal axis, means on the mast by which a drill string may be raised and lowered along a drilling axis, a mouse hole depending from the base and spaced rearwardly of and generally parallel to the drilling axis, a substantially horizontal pipe laydown device on the front side of the mast, and including means by which pipe may be moved longitudinally toward or away from the mast along a path laterally to one side of the drilling axis and mouse hole, an elongate guide mounted on the mast for shifting laterally between a first position in general alignment with said path and a second position in general alignment with the mouse hole and drilling axis, means on the mast for moving the pipe between the laydown device and the guide, when the guide is in its first position, and for raising and lowering the pipe from and into the mouse hole, when the guide is in its second position, and means by which a kelly of the upper end of the drill string may, when released from the remainder of the string, be swung from the raising and lowering means between positions aligned with the drilling axis and in which the lower end of the kelly is generally aligned with the mouse hole, and lowered onto and connected with the upper end of the pipe in the mouse hole, or disconnected from the upper end of such pipe and raised therefrom.

2. The apparatus of claim 1, wherein said means for moving the pipe includes a winch line mounted on the guide and having means on its end for releasable connection to the upper end of the pipe.

3. The apparatus of claim 1, wherein the means for swinging the kelly includes a first arm mounted on the mast for engaging the kelly to move it between positions generally aligned with the drilling axis, as it is released from or made up with the remainder of the drill string, and generally aligned with the pipe in the mouse hole, as it is released therefrom or connected thereto, and a second arm mounted on the mast and movable into and out of a position to engage the kelly, so that, as it is raised or lowered, the first arm may be moved to a position out of the way of a bushing on the kelly.

4. Well drilling apparatus, comprising a base, a mast pivotally mounted on the base for swinging about a horizontal axis and having an open front side, means on the mast by which a drill string may be raised and lowered along a drilling axis, a generally vertical tower mounted on the base on the front side of the mast, said tower having an open side facing the open side of the mast and means for racking stands of pipe in generally vertical positions, means for transferring the stands between the mast and the tower as the drill string is tripped into or out of the well, including a frame extending between the open sides of the mast and tower, and a pivotally mounted support adapted to receive the lower end of a stand in front of the drilling axis, as the lower end of of the stand is raised from and lowered onto the support by the raising and lowering means, and means on the frame for engaging the stand to swing it about the axis of the support between the mast and tower.

5. The apparatus of claim 4, wherein the means for engaging the stand includes an endless chain mounted on the frame, and having an arm on the chain to engage and move the stand between the mast and the tower in response to movement of the chain.

6. The apparatus of claim 5, wherein the frame includes extendible and retractible sections one of which has its free end pivotally connected to the mast and another of which has its free end pivotally connected to the tower, and means for taking up and letting out slack in the chain as the frame is extended and contracted.

7. The apparatus of claim 5, including means on the mast engageable with the stand above the support to swing it into and out of the mast and thus to receive it from the arm, when out of the stand is to be transferred to the mast, and to deliver it to the arm, when the stand section is to be transferred to the tower.

8. The apparatus of claim 4, wherein the support is mounted at the lower end of the tower, and the tower includes means for raising and lowering the lower end of the stand from and onto the support.

9. The apparatus of claim 8, including a pipe laydown device on the front side of the mast and having an inner end beneath the tower, and means for moving pipe between the laydown device and the mast, said support being mounted on the inner end of the laydown device generally beneath the raising and lowering means on the tower.

10. Well drilling apparatus, comprising a base, a mast pivotally mounted on the base for swinging about a horizontal axis and having an open front side, means on the mast by which a drill string may be raised and lowered along a drilling axis, a generally vertical tower mounted on the base on the front side of the mast, said tower having an open side facing the open side of the mast and means from which stands of drill pipe may be racked in a generally vertical position, a frame extending between the mast and tower, and including extendible and retractible sections one of which has its free end pivotally connected to the mast and another of which has its free end pivotally connected to the tower, and means for releasably connecting the sections to one another in selected extended and retracted positions, and means for transferring the stands between the mast and the tower as the drill string is tripped into or out of the well.

11. A pipe laydown device, comprising upper and lower elongate members having front and rear ends, means for moving the upper member between a lower position and an upper position in which the front end of the upper member is above and forwardly of the front end of the lower member, a pair of carts each to receive an end of a drill pipe and mounted on the upper member for movement longitudinally thereof from a rearward position in which to receive a drill pipe from or discharge a drill pipe onto a pipe rack to one side of the members and a forward position in which the front end of the pipe is near the front end of the upper member, a trough mounted on the upper member for movement longitudinally thereof to one side of the carts between a rearward position laterally adjacent the forward position of the carts to receive or discharge a drill pipe from or onto the carts and a forward position in which the front end of the trough is forward of the front end of the upper member, and means by which the drill pipe may be moved between the carts and the trough.

12. The device of claim 11, including a support pivotally mounted on one of the members for swinging about a generally transverse, horizontal axis, and means on the support to receive the lower end of a pipe stand.

13. Well drilling apparatus, including a base, a mast pivotally mounted on the base for swinging about a horizontal axis, means on the mast for raising and lowering a drill string along a drilling axis within the mast, a mouse hole depending from the base rearwardly of and generally parallel to the drilling axis, and an elongate pipe guide mounted on the mast to receive a pipe and shiftable laterally between a first position laterally to one side of the drilling axis and mouse hole and a second position generally aligned with the mouse hole.

14. The apparatus of claim 13, including a winch mounted on the guide and having means on the end of its line for releasable connection with the upper end of a pipe in order to move the pipe into or out of supported position on the guide as well as to raise and lower the pipe when so supported.

15. The apparatus of claim 13, including means mounting the guide on the mast for movement in a longitudinal direction between its second position and a third position generally aligned with the drilling axis.

16. The apparatus of claim 15, including an arm mounted on the mast for engaging the drill string, when it is supported by the raising and lowering means, and movable between positions in which the string is aligned with the drilling axis and in which it is aligned with the mouse hole.

17. The apparatus of claim 16, including means mounting the guide on the mast for movement in a longitudinal direction between its second position and a third position generally aligned with the drilling axis, said guide being engageable by the arm, when the guide is in its second position, to cause the guide to be moved toward and away from its third position.

* * * * *